United States Patent [19]

Peirce, Jr. et al.

[11] Patent Number: 4,911,582

[45] Date of Patent: Mar. 27, 1990

[54] CONCRETE REPLACEMENT WALL AND METHOD OF CONSTRUCTING THE WALL

[75] Inventors: John J. Peirce, Jr., Collegeville, Pa.; David E. Weatherby, Potomac, Md.

[73] Assignee: Schnabel Foundation Company, Bethesda, Md.

[21] Appl. No.: 266,285

[22] Filed: Oct. 27, 1988

Related U.S. Application Data

[63] Continuation of Ser. No. 55,836, Jun. 1, 1987, abandoned.

[51] Int. Cl.[4] ..... E02D 29/02

[52] U.S. Cl. ..... 405/262; 405/286; 405/287

[58] Field of Search ..... 405/260, 262, 272, 284, 405/286, 287

[56] References Cited

U.S. PATENT DOCUMENTS

| | | | |
|---|---|---|---|
| 982,697 | 1/1911 | Upson . | |
| 1,083,289 | 1/1914 | Mason . | |
| 1,270,659 | 6/1918 | Ravier . | |
| 1,298,101 | 3/1919 | Sands . | |
| 1,693,311 | 11/1928 | Miller et al. . | |
| 1,907,135 | 5/1933 | Wemlinger et al. . | |
| 2,902,743 | 9/1959 | King . | |
| 3,250,075 | 5/1966 | Webb et al. . | |
| 3,381,483 | 5/1968 | Huthsing, Jr. . | |
| 3,541,798 | 11/1970 | Schnabel | 405/262 |
| 3,555,830 | 1/1971 | York . | |
| 4,189,891 | 2/1980 | Johnson et al. | 405/262 X |
| 4,242,013 | 12/1980 | Watts . | |
| 4,329,089 | 5/1982 | Hilfiker et al. | 405/262 |
| 4,391,557 | 7/1983 | Hilfiker et al. | 405/287 |
| 4,480,945 | 11/1984 | Schnabel, Jr. . | |
| 4,690,588 | 9/1987 | Berger | 405/262 |
| 4,728,225 | 3/1988 | Brandl et al. . | |

OTHER PUBLICATIONS

Brochure entitled, "Armco Bin Type Retaining Wall Type 2," Article entitled, Port Engineer's Notebook, Dec. 1975, World Ports/American Seaport.

*Primary Examiner*—David H. Corbin

*Attorney, Agent, or Firm*—Banner, Birch, McKie & Beckett

[57] ABSTRACT

A replacement earth retaining wall and a method for modifying, repairing, or replacing an existing earth retaining wall is disclosed. The replacement wall includes a reinforced concrete facing, and soil nails or tiebacks with specially fabricated anchorhead assemblies. The structure includes a concrete panel cast adjacent the face of an existing retaining wall such as a corrugated bin type wall. Tiebacks or soil nails are installed through the existing wall and are encased in the reinforced concrete panel. During construction, tiebacks, where used, are installed through the existing wall and are tensioned against the front face of the existing wall before the concrete panel is cast. The concrete panel is supported by and encases the anchorhead assemblies and covers the outer face of the existing wall. The anchorhead assembly includes a load distribution member, a tube, and tension studs extending from the load distribution member.

33 Claims, 4 Drawing Sheets

CONCRETE REPLACEMENT WALL AND METHOD OF CONSTRUCTING THE WALL

This application is a continuation, of application Ser. No. 055,836 , filed Jun. 1, 1987, now abandoned.

TECHNICAL FIELD

The present invention relates to a concrete earth retaining wall. More particularly, the present invention relates to tiedback and soil nailing reinforced concrete earth retaining walls which are used to replace, modify, or repair an existing earth retaining wall.

BACKGROUND OF THE INVENTION

There are many different types of earth retaining walls. Gravity walls, concrete walls, concrete and timber crib walls, and bin walls are just a few examples. All of these earth retaining walls undergo some deterioration over time. Additionally, there are numerous other reasons for repairing, replacing, or modifying retaining walls. The present invention is directed to replacement walls that can be used with any existing wall. Because bin walls are particularly prone to deterioration, the details of the present invention are illustrated using bin walls.

Steel bin walls are one type of earth retaining wall. Bin walls are constructed by erecting a system of adjoining boxes using lightweight steel members and backfilling the boxes with soil to form a gravity-type retaining wall. Over time, the steel members of the bin walls often corrode thereby weakening the wall. When the corrosion becomes severe, the wall must be repaired or replaced. Sometimes, due to other factors, an otherwise structurally sound wall must be strengthened.

Currently,–repair or replacement of existing earth retaining walls such as bin type walls, use a number of common construction methods and structures. These methods include installing soldier piles and wood lagging behind or through the existing bin wall. All or a portion of the existing bin wall is thereafter removed as excavation proceeds. The bin wall is either replaced with a new bin wall or a different type of retaining wall is constructed in its place. The walls typically used to replace a bin wall include permanent tiedback walls and conventional cantilevered concrete retaining walls.

FIG. 1 illustrates tieback details of a conventional tiedback wall that is used as a replacement wall. As shown in the figure, tieback 1 is secured to soldier beam 2 through its outer anchorage 3 and pipe sleeve 7. The tensile member of tieback 1 is shown as a bar tendon and the soldier beam as an H-beam having flanges 2*a*. Pipe sleeve 7 passes through an opening in outer flange 2*a* and is secured to the web of beam 2 and bears on the inner flange 2*a*. Anchorage 3, including bearing plate 3*a* and nut 3*b*, fastens tieback 1 to soldier beam 2 and is encased within concrete wall 4. A tubular sleeve 5, including seal 5*a*, is disposed around tieback 1 through soldier beam 2. The sleeve and seal hold a corrosion inhibiting compound around the exposed end of the bar tendon. Other conventional structural elements include shear studs 6 attached to soldier beam 2, lagging boards 8, and drainage board 8*a*.

Two types of in-situ ground reinforcement devices used to support retaining walls are tiebacks and soil nails. Tiebacks, also referred to as ground anchors, are often used in the construction industry to support or anchor various structures in the ground. For example, they are often used to support retaining walls bordering highways or to support excavation sheeting to prevent cave-ins which would otherwise endanger lives and property. Such tiebacks generally include an elongate tensile member having an inner anchorage, an unbonded length, and an outer anchorage. The tensile member is often prestressing steel. Formed around the inner end of the tensile member is a cementitious grouted inner anchorage which anchors the tensile member to the earth and distributes to the surrounding ground tensile forces applied to the tensile member. The unbonded length separates the inner anchorage from the outer anchorage and allows the inner anchorage to be located deep behind the wall. The outer anchorage secures the outer end of the tensile member to an excavation sheeting system or other structure to be supported. An example of a typical tieback is illustrated in U.S. Pat. No. 3,490,242. Tiebacks are high load-carrying capacity reinforcement. Tiebacks are tested and tensioned by preloading during installation.

Soil nails, a type of in-situ ground reinforcement device, like tiebacks, provide support for retaining walls. More particularly, soil nails are untensioned tensile members that reinforce the retained earth. Soil nails extend from the retaining wall into the earth and are anchored to the earth along their entire length. They have a lower load-carrying capacity than tiebacks, do not extend as far into the earth as tiebacks, and, during installation, only a small percentage are tested. Soil nails assist in resisting earth pressures, support the weight of the earth, and prevent the formation of slip planes.

Known methods of replacing a deteriorating bin wall require disruption of the area and traffic behind the existing wall during installation of the replacement wall, and partial or complete demolition of the existing wall. There are three primary methods. One method requires the use of temporary sheeting to retain the earth during construction and structural backfill between the replacement wall and temporary sheeting. A second method is illustrated in FIG. 1 and requires that soldier beams be installed in or behind the existing wall.

In a third prior technique, bin walls are replaced by casting a reinforced concrete panel onto the face of the existing bin wall and then installing tiebacks through sleeves placed in the concrete. The tiebacks are locked off or fastened against the concrete panel. The tieback connection or outer anchorage which is exposed and protrudes from the concrete facing is covered with a cap. Because the tiebacks are installed through preexisting sleeves placed in the concrete facing, and the concrete facing is installed before the tiebacks are installed, the location of the tiebacks is fixed by the sleeves. Thus, it is very expensive and aesthetically undesirable to relocate the tiebacks when obstructions prevent the installation of the tiebacks at the location established by the sleeves, or when additional tiebacks are required to replace tiebacks which fail to carry the design load. Furthermore, the repaired wall has an outer anchorage that projects outside the finished wall unless the wall thickness is increased by approximately 8 inches to encase the outer anchorage. Projecting anchorage caps are unattractive and may encroach upon specified clearances which are intended to prevent accidents. Thus, projecting anchorhead caps may be a safety hazard to traffic. A wall of increased thickness suffers from this same problem. When the wall being repaired is along an established railroad or highway right-of-way, it is important to repair the wall using as little space as possible to avoid having to realign the right-of-way in order to maintain the specified clearance.

SUMMARY OF THE INVENTION

It is an object of the present invention to provide a method for modifying, strengthening, repairing, or replacing an existing earth retaining wall, in particular a bin wall, which does not require partial or complete demolition of the existing bin wall, the use of temporary sheeting, or the use of structural backfill between the replacement wall and temporary sheeting.

It is another object of the present invention to provide a concrete replacement earth retaining wall that minimizes area and traffic disruptions during installation.

It is another object of the present invention to provide a concrete replacement earth retaining wall that is relatively thin, has a planar face, and contains recessed anchorheads.

A method of repairing, modifying, or replacing an existing retaining wall includes installing in-situ ground reinforcement devices such as soil nails or tiebacks through the existing retaining wall into the soil behind the wall, tensioning the tiebacks against the existing retaining wall with anchorhead assemblies where tiebacks are used, and casting in place against the existing retaining wall a concrete wall or panel that is supported by the reinforcement devices. Where tiebacks are used, anchorhead assemblies encased in the concrete wall enable the tiebacks to support the concrete panel. Where soil nails are used, bearing plates encased in the concrete wall enable the soil nails to support the concrete panel.

In one preferred embodiment, the reinforcement devices are tiebacks. Where the existing retaining wall is a bin-type retaining wall, each tieback is installed through the bin wall, the anchorhead assemblies are placed over the outer ends of the tensile members of the tiebacks and across valleys of the bin wall, and the valleys may be filled with concrete prior to stressing the tieback. The tieback anchorage includes a bearing plate having an opening, and a securing fastener. The anchorhead assembly may be placed on the tieback before or after filling the valleys of the bin wall. The anchorhead assembly includes a load distribution member to distribute the tension load of the tiebacks to the existing wall. In one embodiment, the load distribution member is a plate having an opening. Alternatively, the load distribution member may be a beam and may serve as part of an anchorhead assembly for multiple tiebacks. The anchorhead assembly also includes a tube secured to the load distribution member and facing the bearing plate support the bearing plate at a predetermined distance outwardly from the load distribution member and perpendicular to the axis of the tensile member of the tieback, and a plurality of tension studs connected to and extending outwardly from the load distribution member. Each tensile member is installed and the anchorhead assembly is passed over the tensile member. Then, the tieback is tested and tensioned, and the securing fastener is fixed to the tensile member. Alternatively, the anchorhead assembly is positioned first, and the tieback is installed through the anchorhead assembly. The area between the load distribution member and the bearing plate and within the interior of the tube is filled with a corrosion inhibiting compound. Where tiebacks and anchorhead assemblies are used, earth or soil pressure applied to the concrete panel is transferred, in turn, to the tension studs, the load distribution member, the tube, the bearing plate, and the tensile member which provides the final wall support.

The load distribution member of the anchorhead assembly allows the tiebacks to be tested and tensioned against the existing bin wall prior to constructing the reinforced concrete panel without crushing or damaging the bin wall. The tube acts as a load transmitting seat for the tieback bearing plate and, in connection with the corrosion inhibiting compound, protects against corrosion in the area immediately below the bearing plate where the tensile members'corrosion protection terminates. The tension studs are encased by the reinforced concrete panel and fix the panel to the tiebacks.

When the reinforcement devices are soil nails anchorhead assemblies are not required. The soil nail includes a rigid tensile member that is anchored along substantially its entire length to the earth behind the wall and an outer anchorage. The outer anchorage includes a bearing plate and a securing fastener such as a nut. The soil nail is not tensioned. The anchorage is embedded totally in the concrete panel cast over the existing wall.

The method of the present invention allows an existing bin wall to be modified, repaired, or replaced without removing the bin wall or disturbing the existing ground behind it. The resulting replacement earth retaining wall requires a minimum amount of space and minimizes disruption to the surrounding areas and existing rights of way. Preferably the replacement earth retaining wall is relatively thin. If the load distribution member is a plate or if soil nails are used, a thickness no greater than 12 inches is desired.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF PREFERRED EMBODIMENTS

Figure 1:
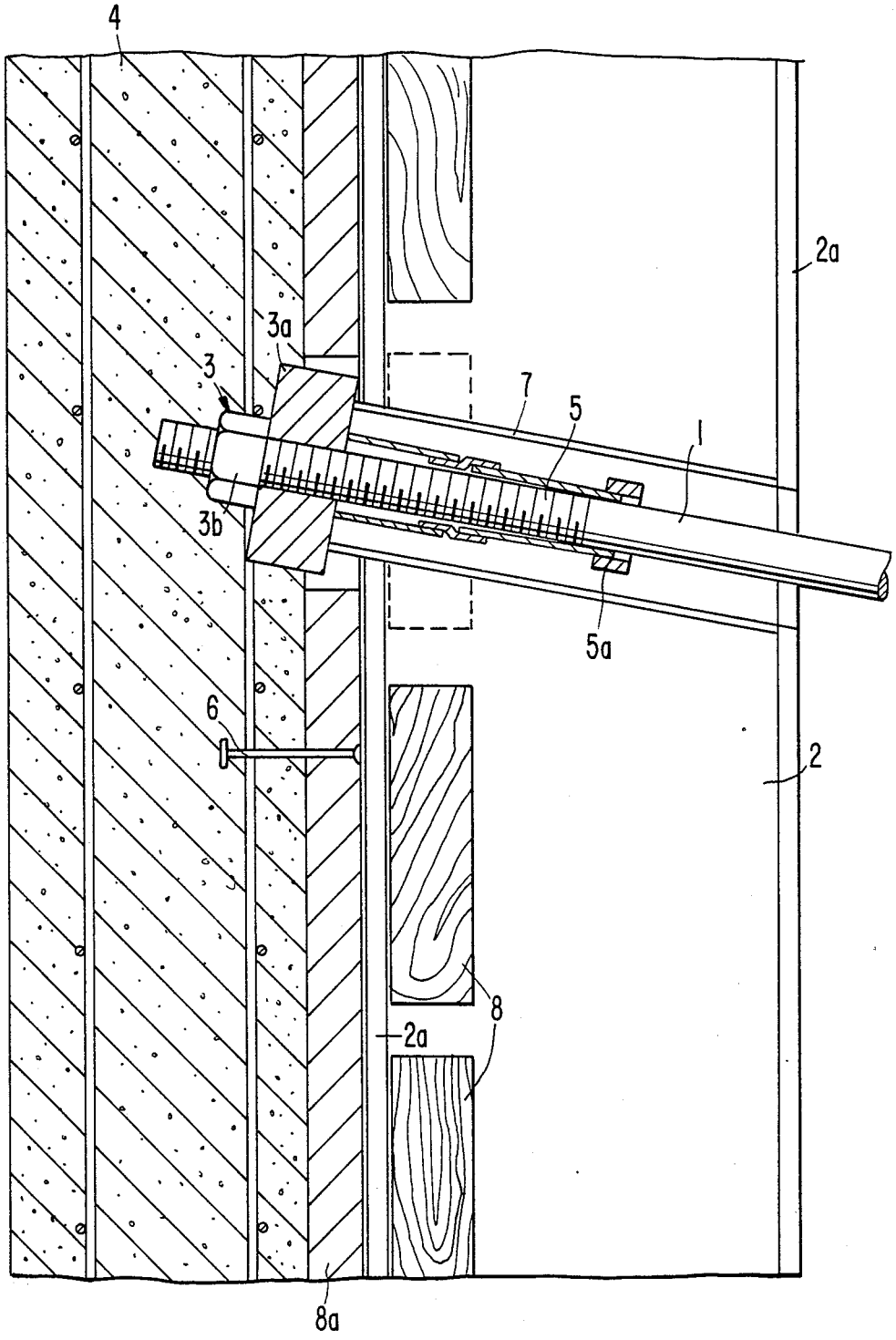
FIG. 1 is a cross-sectional side view of a prior permanent replacement tiedback wall.
Figure 2:
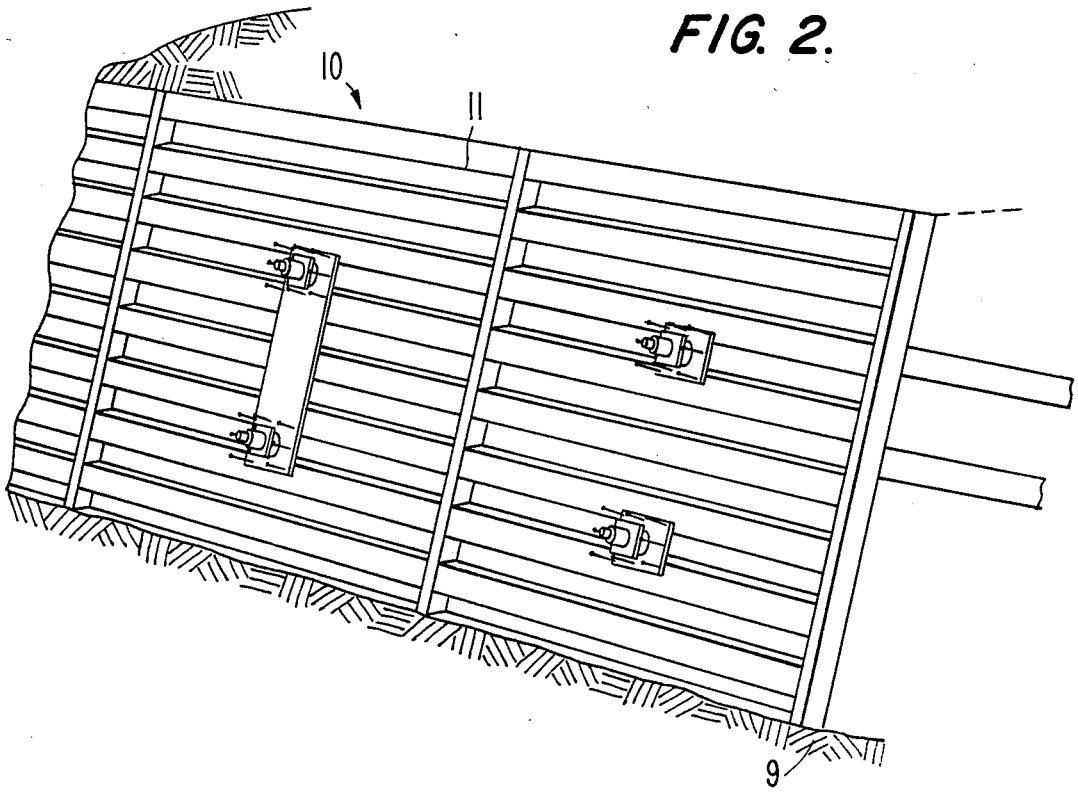
FIG. 2 is a perspective view of a preexisting bin wall after installation of tiebacks according to one embodiment of the present invention.
Figure 3:
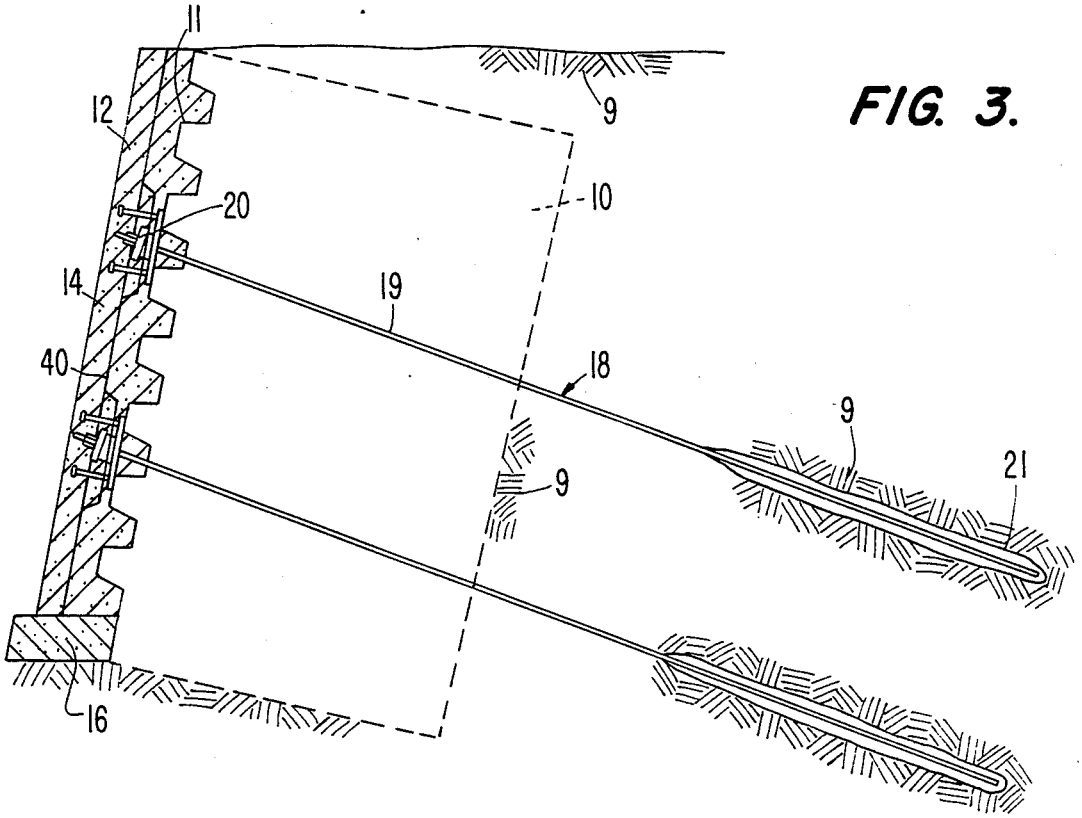
FIG. 3 is a cross section illustrating a reinforced concrete replacement earth retaining wall of FIG. 2 in position against a preexisting bin wall, shown partially in schematic.

As shown in the figures, particularly FIGS. 2 and 3, an existing bin-type wall 10 retains earth 9. Wall 10 is a conventional bin-type wall having a system of adjoining closed-face bins defined by steel members which are bolted together and backfilled with soil. FIGS. 2 and 3 illustrate the outer member in the form of a metal, corrugated bin wall. FIG. 3 illustrates the remainder of backfilled bin-type wall 10 diagramatically in dotted line. Existing bin wall 10 has an exposed face 11 shown, during construction of concrete replacement wall 12, in FIG. 2. In FIG. 3, exposed face 11 is shown repaired by concrete replacement wall 12. Replacement wall 12 includes reinforced concrete panel 14 disposed against exposed face 11 of existing bin wall 10. Concrete panel may be disposed on a concrete work pad 16. Tiebacks 18 are positioned through exposed face 11 and into earth 9. For most applications, at least two levels of tiebacks are required. Tiebacks 18 are formed of a tensile member 19, an outer anchorage including a bearing plate 30 and a securing fastener 32, and an inner anchorage 21. The tensile member 19 of tieback 18 may be a bar as shown, strands, wires, or other suitable tensile members. Tiebacks 18 are fastened to concrete panel 14 by anchorhead assemblies 20.

Figure 4:
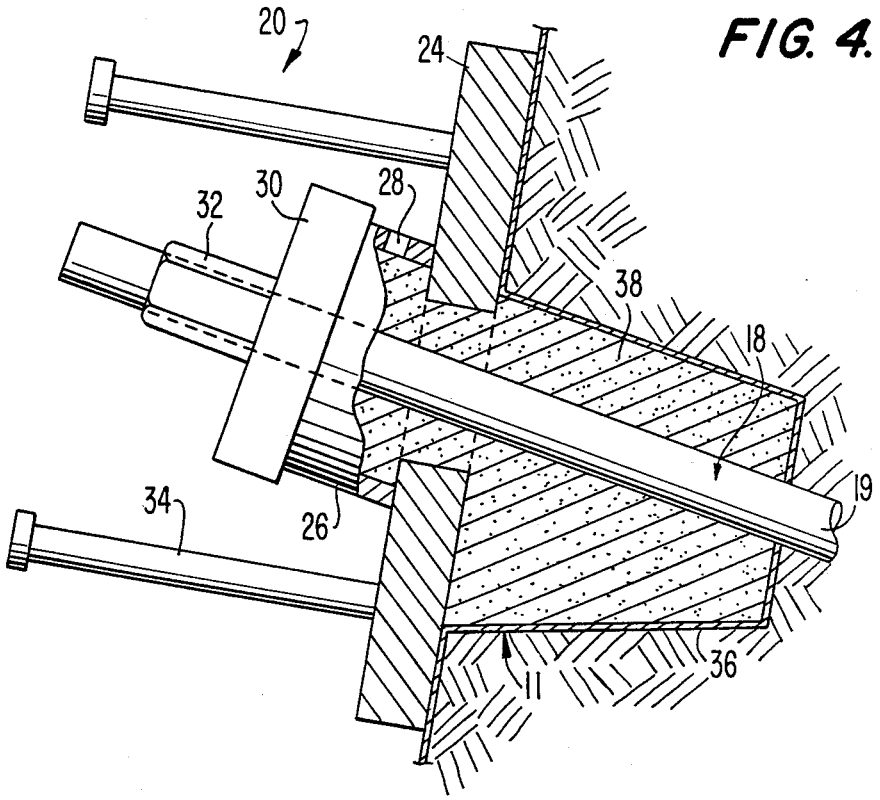
FIG. 4 is a side sectional view of the anchorhead assembly of the present invention against a valley of a bin wall.

Referring to FIG. 4, the tieback anchorage and anchorhead assembly 20 are shown. The tieback anchorage, including bearing plate 30 and a securing fastener such as nut 32, is disposed on the outer end of tensile member 19 of tieback 18. Anchorhead assembly 20 includes load distribution member 24, tube 26, and headed tension studs 34. Load distribution member 24 is preferably made of metal such as steel and has an opening to permit passage of the outer end of tensile member 19. Load distribution member 24, in one embodiment, is a plate as shown in the figures. Alternatively, the load distribution member may be a beam as shown on the left-hand side of FIG. 2. Tube 26, which may be a steel pipe, is disposed around tensile member 19, which protrudes through load distribution member 24. Tube 26 abuts and is connected to load distribution member 24. Tube 26 may have one end surface parallel with load distribution member 24 and has the other end surface perpendicular to the axis of tensile member 19. Tube 26 may include an opening 28 to permit filling tube 26 with a corrosion inhibiting compound such as cement grout or grease to prevent corrosion. Alternatively, corrosion protection may be provided in any of various other ways. Bearing plate 30 is disposed against tube 26. Tensile member 19 of tieback 18 extends through load distribution member 24 and tube 26. Headed tension studs 34 are welded to load distribution member 24 and extend outwardly from load distribution member 24 and into concrete panel 14. Headed tension studs 34 are tension members that serve as a connection for load transfer from concrete panel 14 to load distribution member 24. As shown, tensile member 19 of tieback 18 may penetrate the existing wall through valleys 36 of exposed face 11. Alternatively, tensile member 19 need not pass through valleys 36. Load distribution member 24 is sized so the existing wall is not crushed when the tieback is tensioned. Valleys 36 may be filled with concrete 38 to improve the bearing capacity of the wall. Concrete 38 is not necessary where the load distribution member has a sufficiently large bearing surface which allows face 11 to withstand the load applied during testing of the tiebacks.

Figure 5:
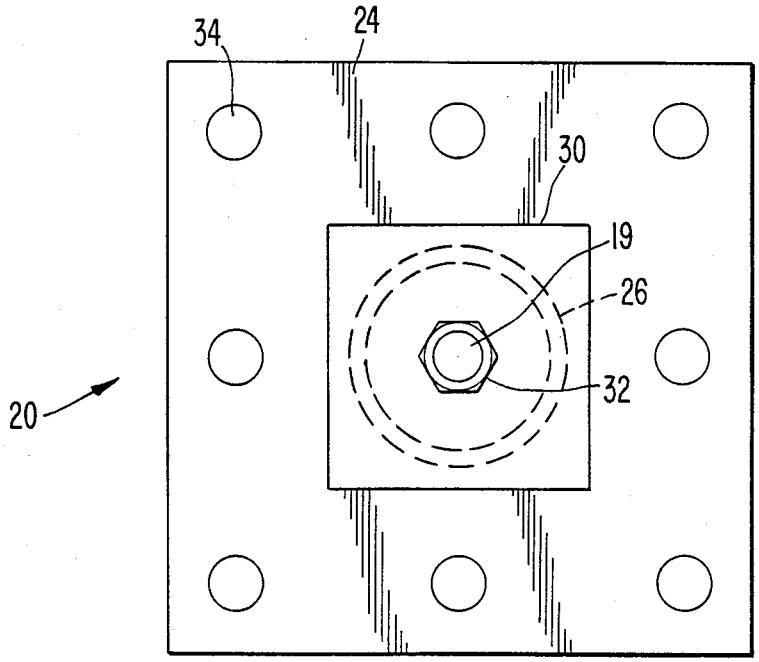
FIG. 5 is an end view of the anchorhead assembly of FIG. 4.

In the preferred embodiment illustrated in FIGS. 4 and 5, anchorhead assembly 20 includes tube 26. Tube 26, in conjunction with a corrosion inhibiting compound, serves as corrosion protection for the end of the tensile member. Tube 26 also transmits loads from load distribution member 24 to bearing plate 30. Tube 26 provides bearing plate 30 with an engagable surface perpendicular to the longitudinal axis of tensile member 19 of tieback 18. In an alternate embodiment, wedge-shaped members may be used to provide an engagable surface perpendicular to tensile member 19 and a separate corrosion protection device is disposed around the outer portion of tensile member 19. Where load distribution member 24 is perpendicular to tensile member 19, no additional member between bearing plate 30 and load distribution member 24 is necessary.

Figure 6:
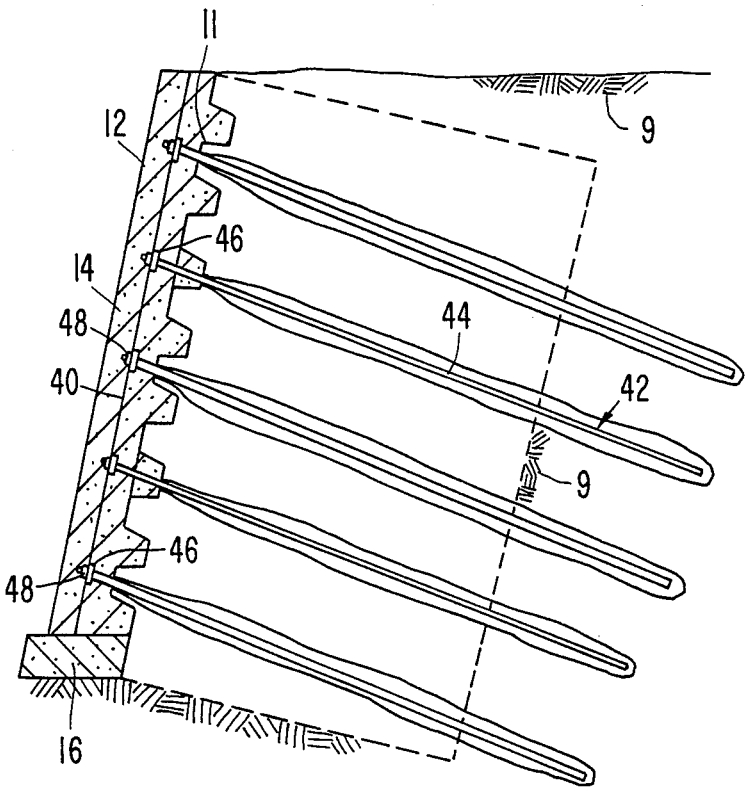
FIG. 6 is a cross section illustrating a concrete replacement earth retaining wall according to another embodiment of the present invention.

In FIG. 6, existing bin-type wall 10 is repaired using soil nails 42. Soil nails 42 extend through exposed face 11 and into earth 9. Soil nails 42 do not extend as far into the earth as tiebacks 18; however, more soil nails than tiebacks are required to reinforce a given wall. Soil nails 42 each include tensile member 44 and an outer anchorage. Soil nails 42 are anchored to the earth along substantially the entire length of the tensile member 44 behind exposed face 11. The outer anchorage of soil nail 42 includes bearing plate 46 and securing fastener 48 such as a nut. The anchorage is encased entirely within concrete panel 14.

The method of constructing the reinforced concrete replacement wall using tiebacks includes the following steps. Each tensile member 19 is installed through exposed face 11 and the back face of existing bin wall 10 and into earth 9, and inner anchorage 21 is installed using any conventional, known method. The tensile members preferably are steel bars, multi-element prestressing steel wires, strands, or tendons. Valleys 36 of exposed face 11 may be filled with concrete 38 in the area surrounding each tensile member 19, if tensile members 19 are disposed in valleys 36, and an anchorhead assembly 20, including load distribution member 24, tube 26, and headed tension studs 34, is placed over the valley and the outer end of each tensile member 19. The outer anchorage, including bearing plate 30 and fastener 32, is placed on tensile member 19. Alternatively, anchorhead assembly 20 may be placed over the valley of exposed face 11 first, and tieback 18 is then positioned by passing tensile member 19 through anchorhead assembly 20 and then positioning bearing plate 30 and securing fastener 32 over tensile member 19.

A tensile load is applied to tensile member 19 and is distributed to the wall using anchorhead assembly 20. The fastener of the upper anchorage secures the tensile member in the tensioned condition. Tube 26 is filled with a corrosion inhibiting compound through opening 28. The tiebacks are thus installed and tensioned against the existing retaining wall prior to casting the concrete panel of the replacement wall. Where used, concrete work pad 16 is constructed below the original or final grade along the base of exposed face 11 of existing bin wall 10. Drainage weep holes 55 may be installed through exposed face 11 if necessary. Other drainage means also may be used. Then, concrete panel 14 is cast in place adjacent to exposed face 11 by a conventional casting technique so that each anchorhead assembly 20 is encased within and supports concrete panel 14.

Concrete panels 14 are preferably reinforced by a grid of reinforcing bars 40, which is positioned before the concrete panels are cast and which may intersect studs 34 of anchorhead assemblies 20. In addition, the anchorhead assemblies may have load distribution members 24 of various shapes and sizes.

Where soil nails are used instead of tiebacks, the method remains essentially the same although the steps are simpler. Soil nail 42 is installed through exposed face 11 and the back face of existing bin wall 10 and into earth 9, and tensile member 44 is anchored to the earth using any conventional, known method. Bearing plate 46 and securing fastener 48 are installed on the outer end of tensile member 44. Then, concrete panel 14 is cast in place and the remaining steps carried out in a manner identical to that for a replacement wall using tiebacks.

The method and replacement wall of the present invention have many advantages. The tiebacks or soil nails are installed and tested prior to constructing the concrete panel. This provides a great degree of flexibility in that the in-situ ground reinforcement devices may be relocated if they fail or if obstructions are in their path. The finished earth retaining wall is planar and thin. There are no projecting anchorhead caps. The wall takes up a minimum amount of space and is very narrow compared with prior replacement walls. Also, the replacement retaining wall is independent of the existing wall. There is no disruption behind the existing wall during construction. The existing wall does not have to be removed and is taken advantage of during the installation of the soil nails and tiebacks by retaining the earth during construction.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

We claim:

1. A method of replacing an existing retaining wall having an exposed face comprising the steps of:

installing reinforcement devices through the existing retaining wall;

anchoring said reinforcement devices in the earth behind the exposed face of the existing retaining wall;

securing the outer ends of the reinforcement devices against the exposed face of the existing retaining wall;

leaving the existing retaining wall in position; and constructing a concrete panel against the existing retaining wall after said reinforcement devices are installed, anchored and secured to encase the outer ends of said reinforcement devices within said concrete panel and behind an outer major face of the concrete panel.

2. A method as set forth in claim 1 further comprising installing said reinforcement devices in a plurality of rows.

3. A method as set forth in claim 1 wherein the step of constructing said concrete panel comprises casting in place said concrete panel in front of the existing retaining wall.

4. A method as set forth in claim 3 wherein said reinforcement devices comprise tiebacks, said tiebacks being stressed against the existing retaining wall with anchorhead assemblies prior to casting said concrete panel, said tiebacks support said concrete panel, and at least one said tieback is disposed through each said anchorhead assembly.

5. A method as set forth in claim 4 wherein the existing retaining wall is a bin type retaining wall having an outer wall formed by a plate having a corrugated shape with peaks and valleys, and further comprising the steps of passing each said tieback through the outer wall, and disposing a load distribution member of each said anchorhead assembly around a respective one of said tiebacks and across at least one valley of the bin type retaining wall.

6. A method as set forth in claim 5 wherein the valleys behind said anchorhead assembly are filled with a supportive material prior to stressing said tieback.

7. A method as set forth in claim 4, wherein each said tieback includes a tensile member and an anchorage having a fastener and a bearing plate, and said anchorhead assembly comprises:

a load distribution member having an opening, said bearing plate being disposed perpendicular to the axis of said tensile member and in load-transmitting connection with said load distribution member; and a plurality of tension studs attached to and extending outwardly from said load distribution member.

8. A method as set forth in claim 7 wherein each said tieback is installed using the following steps:

installing said tensile member through the existing retaining wall and into the earth and forming an inner anchorage around the inner end of said tensile member;

placing said anchorhead assembly over and around the outer end of said tensile member;

placing said bearing plate over and around said tensile member;

tensioning said tensile member; and securing said fastener to said tensile member and against said bearing plate.

9. A method as set forth in claim 7 wherein each said tieback is installed using the following steps:

placing said anchorhead assembly against the exposed face of the existing retaining wall;

installing said tensile member through said anchorhead assembly, through the existing retaining wall, and into the earth, and forming an inner anchorage around the inner end of said tensile member;

placing said bearing plate over and around said tensile member;

tensioning said tensile member; and securing said fastener to said tensile member and against said bearing plate.

10. A method as set forth in claim 8 or 9 wherein said anchorhead assembly further comprises a tube disposed around said tensile member between said load distribution member and said bearing plate, said tube maintaining said bearing plate perpendicular to said tensile member axis, transmitting load from said load distribution member to said bearing plate, and protecting from corrosion the portion of said tensile member between said load distribution member and said bearing plate.

11. A method as set forth in claim 5 wherein said tieback includes a tensile member and an anchorage having a fastener and a bearing plate, said load distribution member has an opening, and said anchorhead assembly further comprises:

a plurality of tension studs attached to and extending outwardly from said load distribution member; and said bearing plate being disposed perpendicular to the axis of said tensile member and in load transmitting connection with said load distribution member.

12. A method as set forth in claim 11 wherein each said tieback is installed using the following steps:

installing said tensile member through the valley of the existing retaining wall and into the earth and forming an inner anchorage around the inner end of said tensile member;

placing said anchorhead assembly over and around the outer end of said tensile member;

placing said bearing plate over and around said tensile member;

tensioning said tensile member; and securing said fastener to said tensile member and against said bearing plate.

13. A method as set forth in claim 11 wherein each said tieback is installed using the following steps:

placing said anchorhead assembly across at least one valley of the exposed face of the existing retaining wall;

installing said tensile member through said anchorhead assembly, through the existing retaining wall, and into the earth, and forming an inner anchorage around the inner end of said tensile member;

placing said bearing plate over and around said tensile member;

tensioning said tensile member; and securing said fastener to said tensile member and against said bearing plate.

14. A method as set forth in claims 12, or 13 wherein said anchorhead assembly further comprises a tube disposed around said tensile member between said load distribution member and said bearing plate, said tube maintaining said bearing plate perpendicular to said tensile member axis, transmitting load from said load distribution member to said bearing plate, and protecting from corrosion the portion of said tensile member between said load distribution member and said bearing plate.

15. A method as set forth in claims 7, 8, 9, 11, 12, or 13 including filling an area located between said load distribution member and said bearing plate with a corrosion inhibiting compound.

16. A method as set forth in claims 1 or 3 including the step of constructing a concrete work pad along the base of the existing retaining wall.

17. A method as set forth in claim 16 further comprising the step of installing drainage means in the existing retaining wall.

18. A method as set forth in claim 3 wherein said reinforcement devices comprise soil nails.

19. A method as set forth in claim 18 wherein the existing retaining wall is a bin type retaining wall having an outer wall formed by a plate having a corrugated shape with peaks and valleys.

20. A method as set forth in claims 18 or 19 wherein each said soil nail comprises a tensile member and an outer anchorage, each said soil nail being installed by passing said tensile member through the existing retaining wall and into the earth, anchoring to the earth substantially the entire length of said tensile member behind the exposed face of the existing retaining wall, and placing said outer anchorage on said exposed end of said soil nail.

21. A method as set forth in claim 20 wherein said anchorage comprises a bearing plate and a fastener.

22. An anchorhead assembly for use in fastening a tieback to a retaining wall and connecting a concrete panel to the tieback comprising:

a load distribution member formed of a substantially flat plate having an inner major surface adapted to be placed against the retaining wall, an opposite outer major surface, and a first opening;

a tube to be disposed around the tieback between the outer major surface of said flat plate load distribution member and a bearing plate of a tieback anchorage having a second opening, said tube maintaining said bearing plate perpendicular to a tensile member of said tieback a predetermined distance outwardly from said flat plate load distribution member with said first opening and the second opening being in alignment to allow the passage of the tensile member of a tieback through said first opening and the second opening, said tube transmitting load from said bearing plate to said flat plate load distribution member, and said tube defining a corrosion inhibiting compound retainer for protecting from corrosion the portion of the tensile member between said load distribution member and the bearing plate; and a plurality of tension studs attached to and extending outwardly from said outer surface of said flat plate load distribution member to accept tension load from the concrete panel.

23. An anchorhead assembly as set forth in claim 22 wherein said tube comprises a filling hole for the passage of the corrosion inhibiting compound into the area in the interior of said tube and between said outer surface of said load distribution member and said inner surface of the bearing plate.

24. An earth retaining wall installed in front of an existing retaining wall having indented areas comprising:

a plurality of anchorhead assemblies placed against the existing retaining wall, each said anchorhead assembly having a load distribution member formed of a flat plate bridging the indented areas of the existing retaining wall;

tiebacks passing through said anchorhead assemblies and the existing retaining wall, said tiebacks being tensioned and secured against said anchorhead assemblies; and a concrete panel disposed in front of the existing retaining wall and supported by and encasing said anchorhead assemblies with said anchorhead assemblies and tiebacks located completely behind an outer major face of said concrete panel.

25. An earth retaining wall as set forth in claim 24 wherein the existing retaining wall is a bin type retaining wall and the indentations are valleys of the bin type retaining wall.

26. An earth retaining wall as set forth in claims 24 or 25 wherein said tieback includes a tensile member and an anchorage having a fastener and bearing plate having an opening, said flat plate load distribution member has an opening, and said anchorhead assemblies further comprise:

a tube disposed around said tensile member between said flat plate load distribution member and said bearing plate, said tube maintaining said bearing plate perpendicular to the axis of said tensile member, transmitting load from said bearing plate to said flat plate load distribution member, and protecting from corrosion the portion of said tensile member between said flat plate load distribution member and said bearing plate; and a plurality of tension studs attached to and extending outwardly from said flat plate load distribution member;

said tensile members extending through said flat plate load distribution member opening and said bearing plate opening, and said concrete wall member being secured to said tension studs.

27. An earth retaining wall as set forth in claim 26 wherein the area between said flat plate load distribution member and said bearing plate, within the interior of said tube and around a respective tensile member is filled with a corrosion inhibiting compound.

28. An earth retaining wall as set forth in claim 27 wherein the indented areas immediately behind said flat plate load distribution members are filled with concrete.

29. An earth retaining wall installed in front of an existing retaining wall comprising a plurality of soil nails disposed through the existing retaining wall and into the earth, each said soil nail comprising a tensile member and an anchorage, said tensile member being anchored to the earth along substantially its entire length behind the existing retaining wall and having an outer end protruding through the existing retaining wall, said anchorage being disposed on said outer end of said tensile member and a concrete panel cast in front of the existing retaining wall and being connected to and encasing said anchorages and said outer ends of said tensile members, said anchorages and said outer ends of said tensile members being located behind an outer major face of said concrete panel.

30. An earth retaining wall as set forth in claim 29 wherein said anchorage comprises a bearing plate and a fastener.

31. A method of replacing an existing retaining wall having an exposed face comprising the steps of:

installing tiebacks through the existing retaining wall by:

inserting a tensile member of each tieback through the existing retaining wall and into the earth and forming an inner anchorage around the inner end of the tensile member;

forming at least one anchorhead assembly of a relatively flat plate load distribution member and a plurality of projections extending from a first major surface of the flat plate load distribution member;

placing said anchorhead assembly over and around the outer end of the tensile member by passing the outer end of the tensile member through a hole in the flat plate load distribution member and with the projections extending away from the existing retaining wall;

tensioning the tensile member against the existing retaining wall and the flat plate load distribution member; and securing a fastener to the outer end of the tensile member;

leaving the existing retaining wall in position; and constructing a concrete panel against the existing retaining wall after the tiebacks are installed, anchored, tensioned and secured to encase the outer ends of tiebacks and the anchorhead assemblies within the concrete panel and to couple the concrete panel to the projections extending from the flat plate load distribution member, with the tiebacks and anchorhead assemblies located behind an outer major face of the concrete panel.

32. A method of replacing an existing retaining wall having an exposed face comprising the steps of:

installing tiebacks through the existing retaining wall by:

forming at least one anchorhead assembly of a relatively flat plate load distribution member and a plurality of projections extending from a major surface of the flat plate load distribution member;

placing a second major surface of the flat plate load distribution member of the anchorhead assembly against the exposed face of the existing retaining wall;

inserting a tensile member of the tieback through a hole in the flat plate load distribution member of the anchorhead assembly, through the existing retaining wall, and into the earth, and forming an inner anchorage around the inner end of the tensile member;

tensioning the tensile member against the existing retaining wall and the flat plate load distribution member; and securing a fastener to the outer end of tensile member;

leaving the existing retaining wall in position;

constructing a concrete panel against the existing retaining wall after the tiebacks are installed, anchored, tensioned and secured to encase the outer ends of the tiebacks and the anchorhead assemblies within said concrete panel and to couple the concrete panel to the projections from the flat plate load distribution member, with the tiebacks and anchorhead assemblies located behind a major face of the concrete panel.

33. A method of replacing an existing retaining wall having an exposed face comprising the steps of:

installing soil nails through the existing retaining wall by:

inserting a tensile member of the soil nail through the existing retaining wall and into the earth;

anchoring to the earth substantially the entire length of the tensile member behind the exposed face of the existing retaining wall; and placing an outer anchorage on an outer exposed end of said soil nail;

leaving the existing retaining wall in position; and constructing a concrete panel against the existing retaining wall after soil nails are installed and anchored to encase the outer ends of soil nails within said concrete panel and to couple the concrete to the outer ends of the soil nails, with the outer ends of the soil nails and outer anchorages located behind an outer major face of the concrete panel.

* * * * *